US007534147B2

(12) United States Patent
Marklove et al.

(10) Patent No.: US 7,534,147 B2
(45) Date of Patent: May 19, 2009

(54) ELECTRICAL CONNECTION APPARATUS

(75) Inventors: Michael Christopher Marklove, Dalton-in-Furness (GB); Jonathan Hardisty, Ulverston (GB); Wesley Barrett, Kendal (GB)

(73) Assignee: Tronic Limited, Cumbria (GB)

( * ) Notice: Subject to any disclaimer, the term of this patent is extended or adjusted under 35 U.S.C. 154(b) by 0 days.

(21) Appl. No.: 11/827,700

(22) Filed: Jul. 13, 2007

(65) Prior Publication Data

US 2008/0020611 A1 Jan. 24, 2008

Related U.S. Application Data

(60) Provisional application No. 60/831,023, filed on Jul. 14, 2006.

(51) Int. Cl.
*H01R 24/00* (2006.01)

(52) U.S. Cl. ..... 439/675

(58) Field of Classification Search ..... 439/578, 439/589, 587, 921, 931, 88, 675
See application file for complete search history.

(56) References Cited

U.S. PATENT DOCUMENTS 4,103,619 A 8/1978 Fletcher et al.
4,306,499 A * 12/1981 Holmes ..... 102/202.4
4,582,385 A * 4/1986 Couper et al. ..... 439/608
5,616,881 A 4/1997 Hansen
2002/0038720 A1* 4/2002 Kai et al. ..... 174/125.1
2005/0054237 A1* 3/2005 Gladd et al. ..... 439/578
2006/0110977 A1* 5/2006 Matthews ..... 439/578
2007/0249225 A1* 10/2007 Sakaguchi et al. ..... 439/578

FOREIGN PATENT DOCUMENTS

EP 0491091 A1 12/1990
EP 0745519 A1 12/1996
GB 2361365 A 10/2001

* cited by examiner

*Primary Examiner*—T C Patel
*Assistant Examiner*—Harshad C Patel
(74) *Attorney, Agent, or Firm*—Alix, Yale & Ristas, LLP

(57) ABSTRACT

Apparatus for providing an electrical connection path into equipment in an underwater, wet or conductive environment, the apparatus comprising a connecting pin having a conductive core and an insulating sleeve around the conductive core. The insulating sleeve has a reduced external diameter over part of its length to form an annular recess, and a collar comprising conductive material is received in the recess for axially retaining the connecting pin in the apparatus and to provide an earth shield.

14 Claims, 3 Drawing Sheets

ELECTRICAL CONNECTION APPARATUS

CROSS-REFERENCE TO RELATED APPLICATION

This application claims the priority of U.S. Provisional Application No. 60/831,023 filed Jul. 14, 2006.

BACKGROUND

The invention relates to apparatus for providing an electrical connection path into equipment in an underwater, wet or conductive environment.

Underwater penetrators are used to provide an electrical connection path through a sealed interface into underwater equipment, for example to connect electrically a conductor of an underwater cable to equipment such as a pump. The conductor of the cable is terminated in a gland assembly which provides a sealed enclosure protecting a connection of the cable conductor to what is commonly referred to as a "penetrator pin". The penetrator pin typically consists of a copper conductive core surrounded by a sleeve of insulating material. The penetrator pin is supported by and passes axially through a metal support flange of the penetrator.

The insulation of the cable may be sealed to the gland assembly by various means including elastomeric seals and encapsulation. The sealed region of the gland assembly may be filled with oil or the like and have one or more flexible diaphragms or walls to allow the pressure inside the assembly to balance with respect to the external pressure and so avoid any tendency for water or other contamination to enter into the gland assembly. The penetrator pin is therefore pressure compensated external of the equipment such as a pump by the gland assembly, but there may be pressure differentials from one end of the penetrator pin to the other (gland end to equipment end), resulting in positive or negative pressure differentials acting directly on the penetrator pin.

A known penetrator pin is shown in FIG. 1. The penetrator pin 1 has a copper conductive core 2 surrounded by an insulating sleeve 3 made of epoxy resin. The penetrator pin extends across an interface between a gland assembly 4 and an item of underwater equipment (not shown). At its gland assembly end, the conductive core 2 is connected to a conductor 17 of an underwater cable. A diaphragm support ring 18 supports one end of diaphragms 19 which protect the conductor 17 and its connection to the conductive core 2 of the penetrator pin. At its other end, the conductive core 2 is connected to the underwater equipment (the connection is not shown). The penetrator pin is supported by a support flange 5. The flange is secured by bolts 6 to the gland assembly 4 and by bolts 7 to a mating flange 8 which forms part of the underwater equipment. The support flange 5 is formed with an axial socket 9 which receives the penetrator pin 1.

The penetrator pin 1 has an annular flange 10 which projects radially outwardly from the central part of the penetrator pin. The flange 10 is supported in the support flange socket 9 between a first compliant seal 11 engaging one annular axial face of the flange 10 and a second compliant seal 12 engaging the opposite annular axial face of the flange 10. A retaining ring 13 is screwed into position to clamp the flange 10 against a shoulder 14 of the socket 9, with the sealing rings 11 and 12 providing resilient bearing surfaces for the flange 10. Due to differential pressures at the gland end and equipment end of the penetrator pin 1, it is subject to axial thrust forces which have to be resisted by the flange 10 carried by the penetrator support flange 5.

A generally cylindrical earth screen 15, made of copper mesh, is embedded in the epoxy resin insulating sleeve 3 and is electrically connected to the penetrator support flange 5 by radially extending conductors 16. The purpose of the earth screen 15 is to protect the insulating sleeve 3 from high electrical stresses in regions of the sleeve where there would otherwise be electrical stress concentration, such as where the epoxy resin is in close proximity to the shoulder 14 of the penetrator support flange 5. Lines of equal electric potential in the epoxy resin become closely spaced at such a discontinuity in the shape of the earthed support flange 5. The electrical stresses can be significant where high voltages are involved, for example at 14 kV and above.

The earth screen 15 is positioned between the conductive core 2 and the support flange 5 and so screens the epoxy material radially outwardly of the earth screen 15, whereby high electrical stresses are reduced and diverted away from such problem areas. The screen itself is generally cylindrical with curved, flared axial ends, so avoiding sharp discontinuities and hence the creation of high electrical stress concentrations in the epoxy resin material radially inwardly of the screen.

Whilst the arrangement of FIG. 1 has been used successfully in the past, the present inventors have now recognised that the provision of the earth screen embedded in the material of the insulating sleeve creates a discontinuity in what would otherwise be a homogeneous material and a potential mechanical weakness, in particular a cylindrical surface along which the insulating sleeve material may shear under the axial loading on the penetrator pin caused by pressure differentials between the gland assembly end and the equipment end.

SUMMARY

There is provided apparatus for providing an electrical connection path into equipment in an underwater, wet or conductive environment, the apparatus comprising a connecting pin having a conductive core and an insulating sleeve around the conductive core, and a collar around the sleeve for axially retaining the connecting pin in the apparatus, the collar comprising conductive material to provide an earth shield radially outwardly of the conductive core.

With such an arrangement, the conductive collar which is located externally of the insulating sleeve can provide an earth shielding function. The use of an earth shield within the body of material forming the insulating sleeve, with any consequent tendency for the insulating sleeve material to fracture under axial loading on the penetrator pin, is avoided.

The conductive collar may engage directly with the insulating material (e.g. epoxy resin) of the insulating sleeve. Preferably, however, a conductive coating is provided on the outside of the insulating sleeve. This ensures that earthing can be provided evenly along the outer surface so as to avoid any localised electrical stress concentration.

The conductive collar may only be conductive in a region in contact with the external surface of the sleeve (or coating on the sleeve), so it could for example be a strong plastics material with a radially inner conductive lining or plate or the like. The collar is preferably made from metal.

Preferably, a layer of conductive or semi-conductive compliant material is provided between the insulating sleeve and the conductive collar. This can provide a certain degree of compliance between the penetrator pin and the collar, so as to smooth the transfer of all mechanical loading between the two in response to axial loading on the penetrator pin. In addition, because the resilient material of this layer is conductive or semi-conductive, the earth shielding effect is ensured.

In certain preferred embodiments, the insulating sleeve has a reduced external diameter over part of its length to form an annular recess, and the collar is at least partly received in the recess. With such an arrangement, because the conductive collar is received in an external annular recess of the insulating sleeve, this helps it to resist axial thrust forces on the penetrator pin. The use of an external radially outwardly projecting flange as part of the insulating sleeve, such as the flange 10 shown in FIG. 1, which is at risk of shearing or fracturing under axial loading, can be avoided.

In a preferred embodiment, the collar, viewed in longitudinal cross-section, has a radially inner profile having an axial end portion which slants, in a direction towards the axial end of the collar, from a radially inner position to a radially outer position. By providing an appropriately shaped slanted axial end portion, the lines of equal electrical potential can be guided radially outwardly without being unduly concentrated. High voltage gradients in the insulating sleeve can be avoided. Such a slanted arrangement may be sufficient at only one end of the collar, but preferably there is a slanted axial end portion at each end of the collar. There may be a central portion and respective slanted end portions. The central portion may be cylindrical and coaxial with the connecting pin.

It may be desirable to avoid sharp changes of direction in the radially inner profile of the collar, so as to minimise electric stress concentrations. Preferably, the collar, viewed in longitudinal cross-section, has a radially inner profile which is curved. In the embodiments having at least one slanted end portion, the slant may have a varying gradient, i.e. a curve. If there is a central cylindrical portion, the transition between this and a slanted end portion is preferably curved.

In the embodiments in which the insulating sleeve has an annular recess, this preferably has a shape complementary to the shape of the radially inner profile of the collar. Any conductive coating on the insulating sleeve or resilient conductive or semi-conductive layer between the sleeve and the collar preferably also has such a complementary shape.

Axial end portions of the annular recess of the insulating sleeve can provide respective axial abutments between the sleeve and the collar, resisting relative longitudinal movement in both axial directions. Thus, by providing the annular recess of the insulating sleeve with end portions which have a radial component as well as an axial one, as viewed in longitudinal cross-section, the end portions can serve to transfer axial loads caused by differential pressures at the opposite ends of the penetrator pin, from the pin to the conductive collar.

It may be possible to form the insulating sleeve by moulding it inside the collar. It is, however, preferable to form the sleeve separately of the collar. Advantageously the collar is split e.g. in an axial plane. This enables it to be located in the annular recess of the insulating sleeve after the sleeve has been made. The collar may, for example, be in the form of two substantially symmetrical halves.

The collar may be secured to a radially outer support member, such as a penetrator support flange, by various means. It is preferably retained in a socket of support means by a retaining ring. The collar preferably has a radially outwardly projecting portion against which the retaining ring engages.

The collar can thus provide an earth shield between the conductive core of the connecting pin and any such radially outer support member.

According to another aspect, there is provided an assembly comprising apparatus as described herein, and in which one end of the connecting pin is exposed to a first pressure and the opposite end of the connecting pin is exposed to a second pressure.

BRIEF DESCRIPTION OF THE DRAWINGS

A preferred embodiment will now be described by way of example and with reference to the accompanying drawings, in which.

DETAILED DESCRIPTION OF THE PREFERRED EMBODIMENTS

Figure 2:
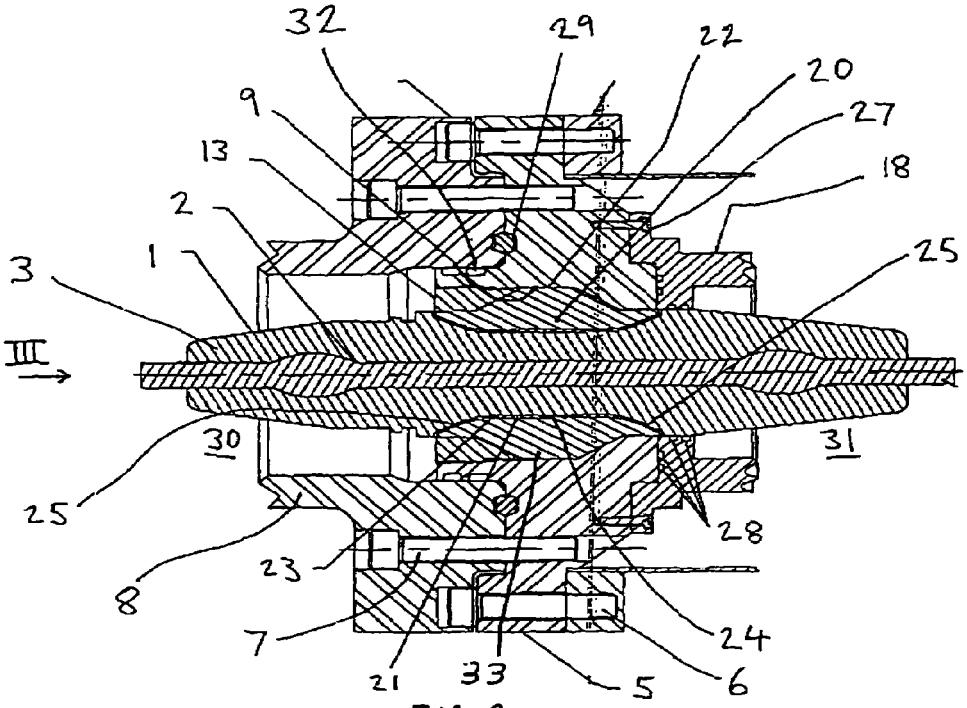
FIG. 2 shows a longitudinal cross-section of an assembly.
Figure 3:
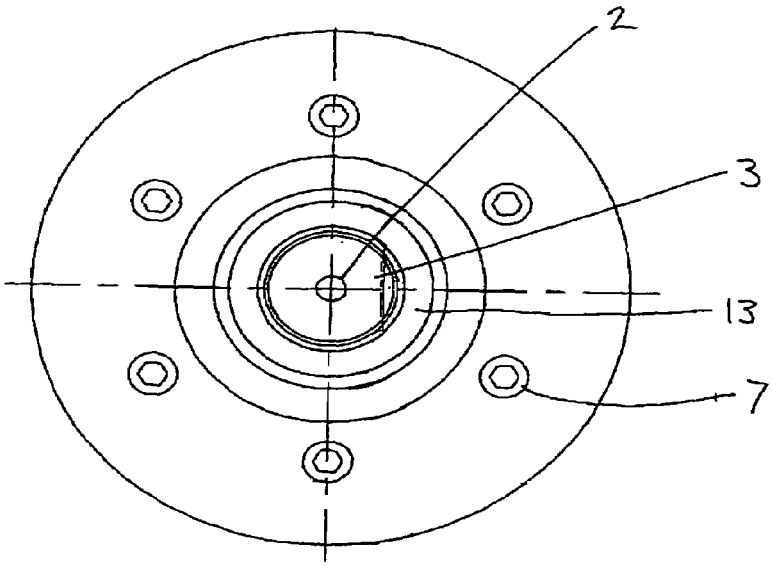
FIG. 3 shows an end view on line III-III of FIG. 2.
Figure 4:
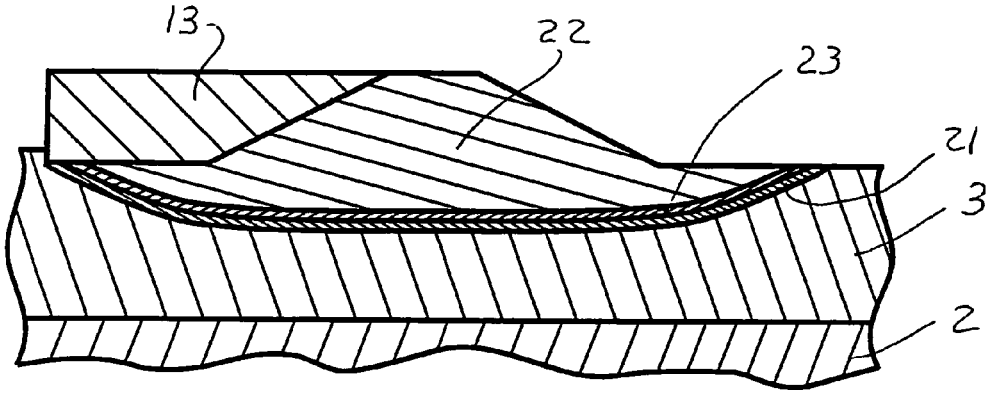
FIG. 4 shows an enlarged partial sectional view of the connection between the insulating sleeve and collar of the assembly of FIG. 2.

Referring to FIGS. 2 and 3, the penetrator pin 1 has a copper conductive core 2 surrounded by an insulating sleeve 3 made of epoxy resin. The penetrator pin extends across an interface between a gland assembly (not shown) and an item of underwater equipment (not shown). At the gland assembly end 31, the conductive core 2 is connected to a conductor 17 of an underwater cable. At the equipment end 30, the conductive core 2 is connected to the underwater equipment (the connection is not shown).

The penetrator pin is supported by a support flange 5. The flange is secured by bolts 6 to the gland assembly 4 and by bolts 7 to a mating flange 8 which forms part of the underwater equipment. A ring type gasket 29 is provided between the axially mating faces of the support flange 5 and the mating flange 8, and "S" type seals 32 are provided between the radially mating faces.

The support flange 5 supports a diaphragm support ring 18, made of a plastics material such as acetal, and is bolted thereto by bolts 27. The diaphragm support ring 18 supports one end of diaphragms 19 which protect the conductor 17 and its connection to the conductive core 2 of the penetrator pin.

A pair of O-rings 28 is provided between the radially outer surface of the insulating sleeve 3 and the diaphragm support ring 18, and another pair of O-rings 28 is provided between the axially engaging surfaces of the ring 18 and the support flange 5.

In a central region, the insulating sleeve 3 of the penetrator pin 1 is formed with a reduced external diameter region forming an annular recess 20. This is coated with a conductive coating 21. The recess is for example "metallised". A metal collar 22 fits in the recess 20. The collar 22 is axially split into two equal halves, the split not being visible in the drawings. The collar 22 is lined with a conductive or semi-conductive resilient polymeric material 23. The recess 20 has a central cylindrical portion 24 extending between respective sloping portions 25 at the axially opposite ends of the recess. Generally, the profile of the recess is smooth, avoiding discontinuities which would tend to cause electrical stress concentration. Thus, the transition between the cylindrical portion 24 and the respective end portions 25 is curved or radiussed.

The penetrator support flange 5 is formed with an axial socket 9 which receives the penetrator pin 1. The collar 22 is received in the axial socket 9 of the support flange 5 and is retained in position by a threaded retaining ring 13 that engages a radially outwardly projecting portion 33 on the collar 22.

Figure 1:
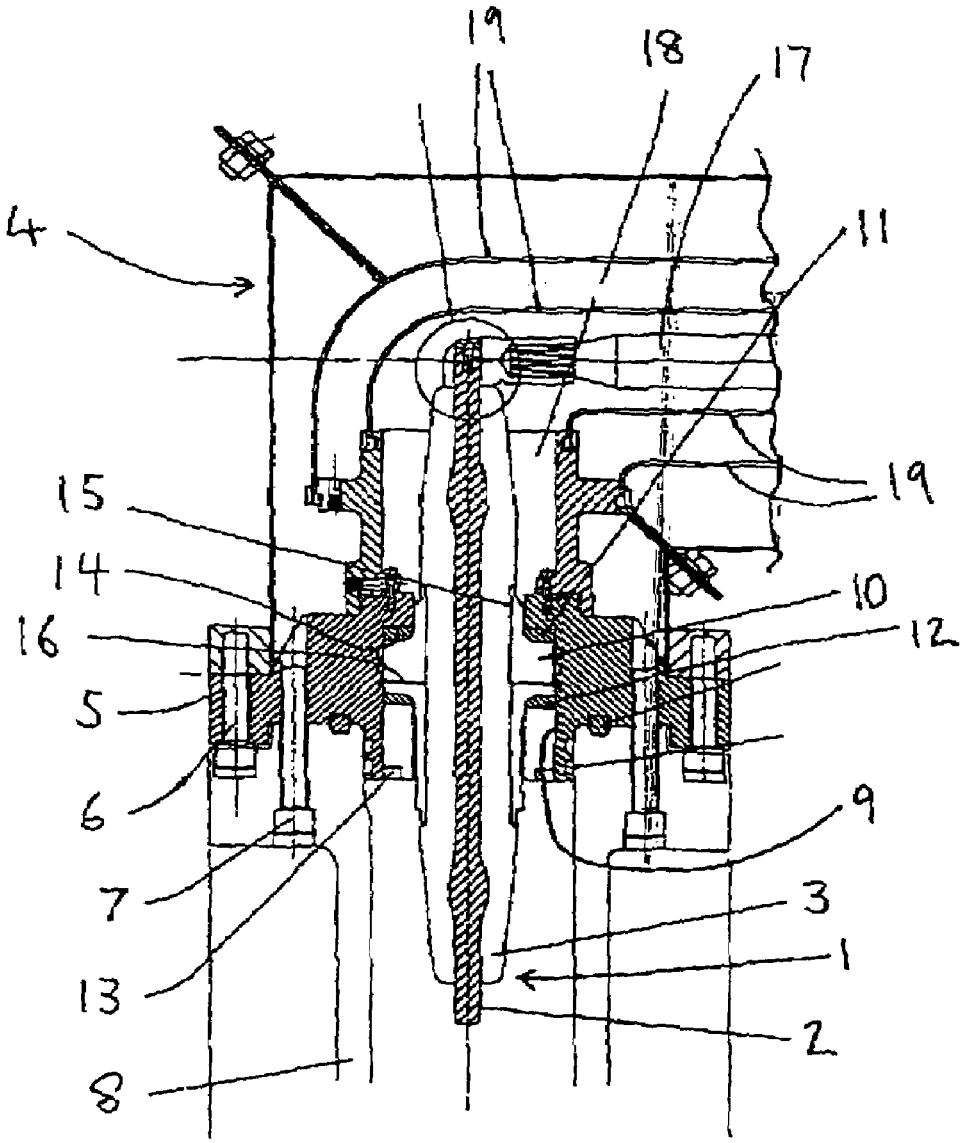
FIG. 1 PRIOR ART
FIG. 1, as mentioned above, shows a longitudinal cross-section of a known penetrator pin assembly.

In use, if the penetrator pin 1 is subjected to axial loads as a result of differential pressures between the gland end 31 and the internal (equipment) end 30, these are resisted by the collar 22. The collar is received in the recess 20 of the sleeve and this assists in transferring axial loads without excessive mechanical stresses in the material of the insulating sleeve. The insulating sleeve is made of epoxy resin which is a very good electrical insulator but is not ideal for use as a mechanical element resisting the differential pressure loading on the penetrator pin. For example, the use of an external, radially outwardly projecting flange 10 such as that shown in FIG. 1 to resist axial thrust forces, with a risk of shearing, can be avoided. Moreover, the insulating sleeve is homogeneously moulded, without an internal earth shield which can lead to mechanical weakness.

In preferred embodiments, the insulating sleeve has no internal earth shield. There is no need to embed an earth shield in the material, e.g. epoxy resin, forming the insulating sleeve. In general, the material extending radially outwardly from the conductive core to the collar (or to any conductive coating on the insulating material or conductive or semi-conductive layer inside the collar) is homogeneous.

The invention claimed is:

1. Apparatus for providing an electrical connection path into equipment in an underwater, wet or conductive environment, the apparatus comprising a connecting pin having a conductive core and an insulating sleeve around the conductive core, and a metal collar around the sleeve for axially retaining the connecting pin in the apparatus, the metal collar providing an earth shield radially outwardly of the conductive core, wherein the insulating sleeve has a reduced external diameter over part of its length to form an annular recess, and said metal collar is at least partially received in said recess.

2. Apparatus as claimed in claim 1, comprising a conductive coating on the recess in the insulating sleeve.

3. Apparatus as claimed in claim 1, comprising a resilient conductive or semi-conductive layer between the insulating sleeve and the collar.

4. Apparatus as claimed in claim 1, wherein the collar, viewed in longitudinal cross-section, has a radially inner profile having an axial end portion which slants, in a direction towards the axial end of the collar, from a radially inner position to a radially outer position.

5. Apparatus as claimed in claim 1, wherein the collar, viewed in longitudinal cross-section, has a radially inner profile which is curved.

6. Apparatus as claimed in claim 1, wherein the collar is split in an axial plane.

7. Apparatus as claimed in claim 1, wherein the collar is received in a support member and is retained by a retaining ring.

8. Apparatus as claimed in claim 7, wherein the collar has a radially outwardly projecting portion against which the retaining ring engages.

9. Apparatus as claimed in claim 1, in an assembly in which one end of the connecting pin is exposed to a first pressure and the opposite end of the connecting pin is exposed to a second pressure.

10. Apparatus as claimed in claim 2, comprising a resilient conductive or semi-conductive layer between the insulating sleeve and the collar.

11. Apparatus as claimed in claim 2, wherein the collar, viewed in longitudinal cross-section, has a radially inner profile having an axial end portion which slants, in a direction towards the axial end of the collar, from a radially inner position to a radially outer position.

12. Apparatus as claimed in claim 2, wherein the collar, viewed in longitudinal cross-section, has a radially inner profile which is curved.

13. Apparatus as claimed in claim 2, wherein the collar is split in an axial plane.

14. Apparatus as claimed in claim 2, wherein the collar is received in a support member and is retained by a retaining ring.

* * * * *